US006576068B2

(12) United States Patent
Grubb et al.

(10) Patent No.: US 6,576,068 B2
(45) Date of Patent: Jun. 10, 2003

(54) METHOD OF PRODUCING STAINLESS STEELS HAVING IMPROVED CORROSION RESISTANCE

(75) Inventors: John F. Grubb, Lower Burrell, PA (US); James D. Fritz, Cabot, PA (US)

(73) Assignee: ATI Properties, Inc., Albany, OR (US)

( * ) Notice: Subject to any disclaimer, the term of this patent is extended or adjusted under 35 U.S.C. 154(b) by 0 days.

(21) Appl. No.: 09/841,330

(22) Filed: Apr. 24, 2001

(65) Prior Publication Data

US 2002/0189399 A1 Dec. 19, 2002

(51) Int. Cl.[7] ..... C21D 8/00; C21D 6/00; C22C 38/44; C22C 30/00

(52) U.S. Cl. ..... 148/327; 148/442; 148/639; 148/565; 148/542; 148/643; 148/566; 148/607; 148/608

(58) Field of Search ..... 148/607, 608, 148/639, 643, 675, 676, 677, 442, 512, 542, 547, 548, 555, 557, 565, 566, 327, 440; 420/52, 586.1

(56) References Cited

U.S. PATENT DOCUMENTS

| | | | | |
|---|---|---|---|---|
| 3,785,876 A | | 1/1974 | Bailey | |
| 4,043,810 A | | 8/1977 | Acuncius et al. | |
| 4,080,201 A | | 3/1978 | Hodge et al. | |
| 4,545,826 A | | 10/1985 | McCunn et al. | |
| 4,554,028 A | * | 11/1985 | DeBold et al. | 148/38 |
| 4,788,036 A | | 11/1988 | Eiselstein et al. | |
| 4,911,886 A | | 3/1990 | Pitler et al. | |
| 5,019,184 A | | 5/1991 | Crum et al. | |
| 5,945,067 A | | 8/1999 | Hibner et al. | |

OTHER PUBLICATIONS

Philip J. Dudt, "Laser Surface Treatment of Autogenous Superaustenitic Weldments" Naval Surface Warfare Center, Caderock Division (2001).

John F. Grubb et al., "Developments in 6% Mo stainless steels" Stainless Steel World 99 Conference on Corrosion–Resistant Alloys Conference Papers Book 2, pp. 499–505 KCI Publishing, The Hague, The Netherlands (1999).

J.M. Pool et al., "The Effect of Ingot Homogenization Practice on the Properties of Wrought Alloy 718 and Structure" *Superalloy 718—Metallurgy and Applications* (The Minerals, Metals & Materials Society, 1989), pp. 219–228.

"Alloy Digest" data sheet for Allegheny Ludlum AL–6XN® Alloy (1988).

* cited by examiner

*Primary Examiner*—Deborah Yee
(74) *Attorney, Agent, or Firm*—Patrick J. Viccaro

(57) ABSTRACT

A method for producing a stainless steel with improved corrosion resistance includes homogenizing at least a portion of an article of a stainless steel including chromium, nickel, and molybdenum and having a $PRE_N$ of at least 50, as calculated by the equation:

$$PRE_N = Cr + (3.3 \times Mo) + (30 \times N),$$

where Cr is weight percent chromium, Mo is weight percent molybdenum, and N is weight percent nitrogen in the steel. In one form of the method, at least a portion of the article is remelted to homogenize the portion. In another form of the method, the article is annealed under conditions sufficient to homogenize at least a surface region of the article. The method of the invention enhances corrosion resistance of the stainless steel as reflected by the steel's critical crevice corrosion temperature.

37 Claims, 3 Drawing Sheets

METHOD OF PRODUCING STAINLESS STEELS HAVING IMPROVED CORROSION RESISTANCE

CROSS REFERENCE TO RELATED APPLICATIONS

Not applicable.

STATEMENT REGARDING FEDERALLY SPONSORED RESEARCH OR DEVELOPMENT

Not applicable.

TECHNICAL FIELD AND INDUSTRIAL APPLICABILITY OF THE INVENTION

The present invention relates to a method for producing Cr—Ni—Mo stainless steels having a high degree of resistance to localized corrosion. More particularly, stainless steels produced by the method of the present invention may demonstrate enhanced resistance to pitting, crevice corrosion, and stress corrosion cracking, making the steels suitable for a variety of uses such as, for example, in chloride ion-containing environments. These uses include, but are not limited to, condenser tubing, offshore platform equipment, heat exchangers, shell and tank construction for the pulp and paper industries, chemical process equipment, brewery equipment, feed-water heaters, flue gas desulfurization applications and use in the sea or coastal regions where the alloy may be exposed to marine atmospheric conditions.

DESCRIPTION OF THE INVENTION BACKGROUND

Stainless steel alloys possess general corrosion resistance properties, making them useful for a variety of applications in corrosive environments. Examples of corrosion resistant stainless steel alloys are seen in U.S. Pat. No. 4,545,826 to McCunn and No. 4,911,886 to Pitler. Despite the general corrosion resistance of stainless steel alloys, chloride ion-containing environments, such as seawater and certain chemical processing environments, may be extremely aggressive in corroding these alloys. The corrosive attack most commonly appears as pitting and crevice corrosion, both of which may become severe forms of corrosion. Pitting is a process of forming localized, small cavities on a metallic surface by corrosion. These cavities are the result of localized corrosion and typically are confined to a point or small area. Crevice corrosion, which can be considered a severe form of pitting, is a localized corrosion of a metal surface at, or immediately adjacent to, an area that is shielded from full exposure to the environment by the surface of another material.

In testing and development of alloys of this kind, the corrosion resistance of an alloy may be predicted by its Critical Crevice Corrosion Temperature ("CCCT"). The CCCT of an alloy is the lowest temperature at which crevice corrosion occurs on samples of the alloy in a specific environment. The CCCT is typically determined in accordance with ASTM Standard G-48. The higher the CCCT, the greater the corrosion resistance of the alloy. Thus, for alloys exposed to harsher corrosive environments it is desirable for an alloy to possess as high a CCCT as possible.

Superaustenitic stainless steel alloys containing chromium and molybdenum provide improved resistance to pitting and crevice corrosion in comparison to prior art alloys. Chromium contributes to the oxidation and general corrosion resistance of the alloy. It also has the desired effects of raising the CCCT of an alloy and promoting the solubility of nitrogen, the significance of which is discussed below.

Nickel, a common element used in stainless steel alloys, is typically added for purposes of making the alloy austenitic, as well as contributing to the resistance of stress corrosion cracking ("SCC"). SCC is a corrosion mechanism in which the combination of a susceptible alloy, sustained tensile stress, and a particular environment leads to cracking of the metal. Typically, addition of nickel and molybdenum to a stainless steel increases its resistance to SCC as compared to standard austenitic stainless steels. However, the nickel and molybdenum-containing alloys are not totally immune from SCC.

Molybdenum may be added to a stainless steel alloy to increase the alloy's resistance to pitting and crevice corrosion caused by chloride ions. Unfortunately, molybdenum may segregate during solidification, resulting in concentration of only two-thirds of the average molybdenum content of the alloy in dendrite cores. During metal casting, excess molybdenum is segregated into liquid metal ahead of the solidification front, resulting in formation of one or more eutectic phases within the alloy. In a continuous cast product, for example, this eutectic phase is frequently formed at or near the slab centerline. In many austenitic corrosion resistant alloys, the eutectic is composed of ferrite (body-centered cubic (BCC) Fe—Cr solution) in addition to austenite (face-centered cubic (FCC) Fe—Ni—Cr solution) phases. For certain alloys compositions useful in connection with the present invention, the eutectic has been observed to be composed of austenite plus intermetallic phases. The intermetallic phase is typically sigma, chi, or Laves phase. Although sigma and chi phases have different structures, they may have similar compositions depending upon the conditions of intermetallic phase formation. These intermetallic phases, as well as other eutectic phases, may compromise the corrosion resistance of the alloy.

Nitrogen may typically be added to an alloy to suppress the development of sigma and chi phases, thereby contributing to the austenitic microstructure of the alloy and promoting higher CCCT values. However, nitrogen content must be kept low to avoid porosity in the alloy and problems during hot working. Nitrogen also contributes to increased strength of the alloy, as well as enhanced resistance to pitting and crevice corrosion.

Typically, the ability of an alloy to resist localized corrosive attack is critical in many industrial applications. Thus, there exists a need for a method of producing stainless steels that provide improved resistance to pitting and crevice corrosion. More particularly, there exists a need for a method of producing stainless steels that provide improved resistance to pitting and crevice corrosion at higher temperatures, as indicated by, for example, the CCCT.

SUMMARY OF THE INVENTION

The present invention addresses the above-described needs by providing a method for producing Cr—Ni—Mo stainless steels having improved corrosion resistance. In one form, the method includes providing an article of a stainless steel including chromium, nickel, and molybdenum and having a $PRE_N$ greater than or equal to 50, and remelting at least a portion of the article to homogenize the portion. As examples, a portion, such as a surface region of the article, may be remelted, or the entire article may be remelted to homogenize the article or remelted portion. As used herein, $PRE_N$ is calculated by the equation $PRE_N$=Cr+(3.3×Mo)+(30×N), where Cr represents the weight percentage of chromium in the alloy, Mo represents the weight percentage of molybdenum in the alloy, and N represents the weight percentage of nitrogen in the alloy. In one embodiment of the method, the Cr—Ni—Mo stainless steel comprises, by weight, 17 to 40% nickel, 14 to 22% chromium, 6 to 12% molybdenum, and 0.15 to 0.50% nitrogen.

The present invention further addresses the above-described needs by providing a method for producing such corrosion resistant stainless steels, wherein a melt of stainless steel including chromium, nickel, and molybdenum and having a $PRE_N$ greater than or equal to 50 (calculated by the equation above) is cast to an ingot, slab, or other article, and is subsequently annealed for an extended period. The annealing treatment may be conducted prior or subsequent to hot working and is performed at a temperature and for a time sufficient to increase the homogeneity of (i.e. "homogenize") the stainless steel. In one embodiment of the method, the stainless steel comprises, by weight, 17 to 40% nickel, 14 to 22% chromium, 6 to 12% molybdenum, and 0.15 to 0.50% nitrogen.

The inventors have determined that the method of the present invention significantly increases the Critical Crevice Corrosion Temperature (CCCT) of Cr—Ni—Mo stainless steels produced by the method without the increased costs of alloy additions. In addition, the method of the present invention enhances corrosion resistance without the effect on manufacturing operations associated with processing higher alloyed materials.

The present invention also is directed to corrosion resistant Cr—Ni—Mo stainless steels produced by the method of the present invention, and to articles formed of or including those steels. Such articles include, for example, plates and sheet.

The reader will appreciate the foregoing details and advantages of the present invention, as well as others, upon consideration of the following detailed description of embodiments of the invention. The reader also may comprehend additional details and advantages of the present invention upon making and/or using the method and/or the stainless steels of the present invention.

DETAILED DESCRIPTION OF EMBODIMENTS OF THE INVENTION

Figure 1:
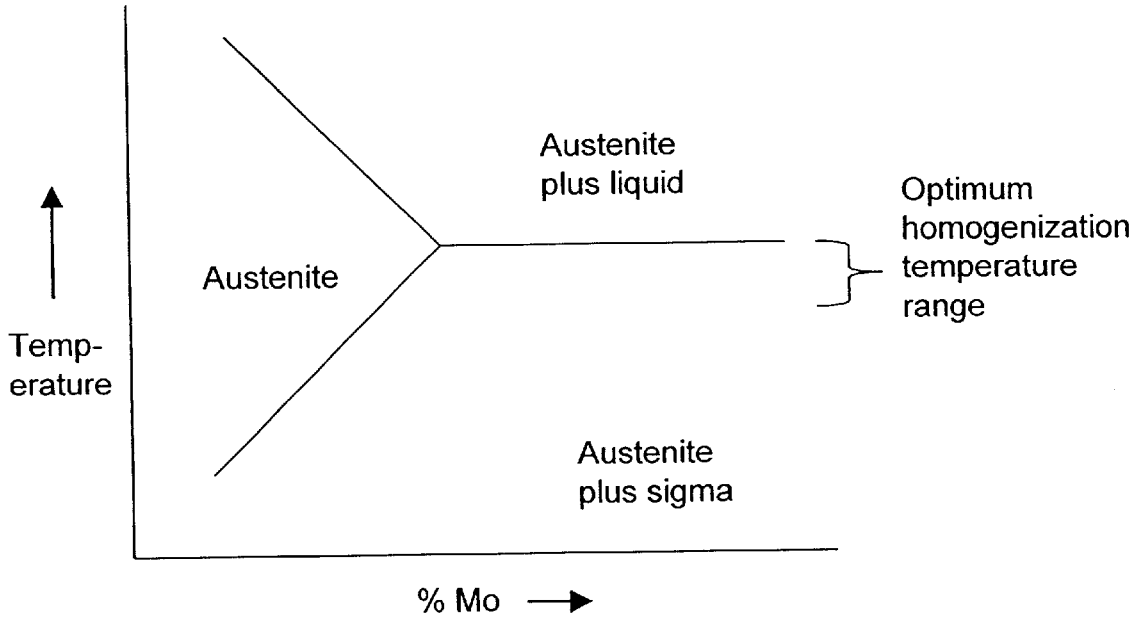
FIG. 1 is a diagram of the high temperature phases in an alloy showing the effect of temperature on the homogeneity of the alloy, based on the temperature of maximum solubility of molybdenum.

A process for producing a corrosion resistant article exhibiting resistance to pitting and crevice corrosion would be highly advantageous. The present invention is directed toward a method of producing an article from a homogenous Cr—Ni—Mo stainless steel alloy having a high degree of corrosion resistance. The unique corrosion resistance properties seen in the present disclosure may be produced by the combination of (i) preparing a melt of Cr—Ni—Mo stainless steel with a Pitting Resistance Equivalent number ($PRE_N$) greater than or equal to 50.0 (as calculated from $PRE_N$=Cr+(3.3×Mo)+(30×N), where Cr represents the weight percentage of chromium in the alloy, Mo represents the weight percentage of molybdenum in the alloy, and N represents the weight percentage of nitrogen in the alloy) and (ii) processing a slab, or ingot or other article formed from the melt to reduce the segregation of Mo and other alloying elements and/or to homogenize previously segregated material. To homogenize an alloy is to reduce segregation of alloying elements. However, the alloy need not be homogenized to a completely uniform composition throughout the article in order to benefit with increased corrosion resistance. In one embodiment, the Cr—Ni—Mo stainless steel may comprise, by weight, 17 to 40% nickel, 14 to 22% chromium, 6 to 12% molybdenum, and 0.15 to 0.50% nitrogen. The balance of the alloy may comprise iron along with incidental impurities and other elements added for some auxiliary purpose as is well known in stainless steel production.

Optionally, the alloy may also contain up to 6 weight percent, and more preferably up to 2 weight percent, manganese. Manganese tends to increase the solubility of nitrogen. As stated previously, nitrogen may typically be added to an alloy to suppress the development of sigma and chi phases, thereby contributing to the austenitic microstructure of the alloy and promoting higher CCCT values. Nitrogen also contributes to increased strength of the alloy, as well as enhanced resistance to crevice corrosion.

The relative pitting resistance of a stainless steel can be correlated to alloy composition using the $PRE_N$ formula. Commentators have suggested various formulas for determining $PRE_N$. One such formula is used here, as set forth above. The $PRE_N$, while not a direct measure of corrosion resistance, does provide a useful prediction, based upon alloy composition, of the relative resistance of a stainless steel alloy to chloride-induced localized corrosion attack.

With a $PRE_N$ equal to or greater than 50, the alloy resulting from the method of the present invention has been found to demonstrate outstanding resistance to localized chloride attack such as pitting and crevice corrosion. However, it is the composition of the alloy in the local region exposed to corrosive conditions, rather than the average overall composition of the alloy, that is determinate of the corrosion resistance of the metal. In developing the present invention, it was discovered that non-homogenous stainless steel alloys are more susceptible to corrosion than are more homogenous superaustenitic alloys. During production, certain alloying elements may segregate or concentrate into secondary phases. In these cases, the individual elements comprising the alloy are not evenly dispersed throughout the alloy. Thus, while the composition as designed may be effective in resisting corrosion, certain localized areas of the alloy do not comprise the desired composition. These areas may then be more susceptible to corrosive attack by chloride ion, resulting in pitting and crevice corrosion. This is demonstrated by the problems associated with molybdenum segregation discussed previously. While molybdenum contributes superior corrosion resistant properties, it may segregate into several intermetallic phases. Accordingly, those areas of the alloy having lower molybdenum concentrations are more susceptible to corrosive attack.

Typically, in a prior art method a heat is prepared having the elemental composition of the desired alloy. The heat may be prepared by any conventional means known in the production of stainless steel, including, but not limited to, argon-oxygen-decarburization ("AOD"). In an AOD process, a premelt may be prepared in an electric-arc furnace by charging high-carbon ferrochrome, ferrosilicon, stainless steel scrap, burned lime, and fluorspar and melting the charge to the desired temperature in a conventional manner. The heat is then tapped, deslagged, weighed, and transferred into an AOD vessel for refining to final desired alloy chemistry.

The heat may then be cast into an ingot, slab, or other article. Casting the article may be achieved by any conventional manner known in the art, including, but not limited to, continuous slab casting, ingot casting, or thin slab casting.

Next, the cast article is reheated and saddened. Reheating typically is conducted at a temperature greater than 2000° F. (1093° C.) and may be performed at 2250–2300° F. (1232–1260° C.). Duration of reheating varies with thickness, but must be long enough to achieve essentially uniform temperature throughout the work piece. Typically, times of about 30 minutes per inch of thickness are used. The minimum reheat temperature is limited by the increasing strength of the material at lower temperatures, while hot shortness or incipient melting controls the upper temperature. The article may be initially hot worked (saddened) from a slab or ingot form by hot rolling or forging, depending on the final product form desired, in one or more stages.

Optionally, surface preparation may be performed following the initial hot working step. This surface preparation is typically done to remove surface defects. These defects may include ingot mold spatter, seams, slivers, and shallow cracks.

For plate steel, the saddened slab may at this time be cut into pieces that will provide the desired plate size once it has been rolled to the desired final thickness. Each piece may then be further hot worked by being reheated to, for example, 2200–2250° F. (1204–1232° C.) as described previously and hot rolled to the desired thickness.

For sheet steel, the saddened slab is typically further hot worked by being reheated to 2250–2300° F. (1232–1260° C.) and rolled until its thickness is reduced to about 1 to 1.5 inches thick (25.4 to 38.1 mm). This rolling is typically bi-directional (reduction during both forward and reverse passes on a reversing mill or Steckel mill), but may in some cases be done uni-directionally (reduction only on forward passes). As soon as the desired thickness is achieved, the reduced slab, often called a transfer bar, immediately is fed into a multi-stand hot mill where it is reduced to a coilable thickness, often about 0.180 inches thick, and subsequently hot coiled.

After hot working, the article may be annealed. For sheet and plate products, annealing is usually done above about 2000° F. (1093° C.), followed by rapid cooling. The minimum annealing temperature (defined by product specifications such as ASTM A-480) is determined by the need to ensure that intermetallic phase precipitation does not occur and that pre-existing intermetallic phase precipitates are dissolved. Annealing can be performed at higher temperatures, up to about 2350° F. (1288° C.). Annealing at higher than the minimum necessary temperature may be undesirable for the following reasons: increased energy cost; increased equipment cost; reduced equipment availability; reduced product strength (possibly below specification minima); excessive grain growth; and excessive oxidation.

Annealing above 2300° F. (1260° C.) increases the risk of melting of the article. The exact temperature of melting will vary with alloy composition, content of residual elements, and degree of segregation.

Following annealing, the surface of the steel may be prepared by cleaning using any conventional means. The first step typically is removal of oxide scale from the surface. For hot rolled material, this descaling process is usually done mechanically. Typically, the annealed material is blasted with steel shot, steel grit, sand, glass beads, or other hard, durable particulate material to remove the oxide scale. Alternatively, the scale may be removed by grinding or via chemical processes. Chemical processes for scale removal include molten salts and acid pickling. In addition to its use as the sole method of cleaning, acid pickling usually follows mechanical (blast) descaling and molten salt treatments. Acid pickling completes removal of residual oxide particles and removes the most severely chromium depleted surface that underlies the surface oxide scale. The goal of this surface cleaning depends upon the subsequent use of the article in question.

For plate product, surface cleaning is often the last metallurgically significant procedure in the production sequence. The goal of the surface cleaning step is the production of a surface that is clean and exhibits good corrosion resistance. For sheet product, surface cleaning is less important for the end product quality (since the product will be cleaned again later). The goal of surface cleaning sheet is to provide a surface that is clean and will not contaminate subsequent cold rolling operations and equipment with lose detritus.

Following the above steps, optionally, the article may then be cold rolled and annealed a final time using conventional methods known in the production of stainless steel. The product is then cleaned once again. Depending upon the thickness of the material, this descaling process may be done mechanically or chemically. Acid pickling completes removal of residual oxide particles and removes the most severely chromium depleted surface that underlies the surface oxide scale. The goal of this cleaning step is the production of a surface that is clean and exhibits good corrosion resistance.

In one form, the present invention modifies the above process by adding one or more homogenization steps in the form of remelting and/or extended annealing. Tables 1–5 and Examples 1 and 2, set forth below, demonstrate the advantages of the present invention. Tables 1 and 2 provide crevice corrosion test results for a Cr—Ni—Mo stainless steel having a $PRE_N$ of 50 or greater produced by prior art methods (Tables 1 and 2) as generally described above. Table 3 provides crevice corrosion test results for a stainless steel of the same composition (and $PRE_N$) that has been homogenized by electroslag remelting during processing according to the present invention. Tables 4 and 5 provide crevice corrosion test results for a stainless steel of the same composition (and $PRE_N$) that has been homogenized by being subjected to an extended annealing treatment during processing according to the present invention.

The corrosion results included in Tables 1–5 were derived using either a modified ASTM G-48 Practice B crevice corrosion test (Tables 1, 3, and 4) or a modified ASTM G-48 Practice D crevice corrosion test (Tables 2 and 5). In each test type, devices known as "blocks" are used to promote the formation of corrosion crevices on a surface of test samples. These blocks, which are cylinders of fluorocarbon plastic, are pressed against the surface of the test samples by standardized rubber bands. Attack under the crevice-forming blocks is the intended mode of material failure in the tests. Where the rubber bands wrap around the edges of the alloy samples, additional crevice areas may be created. While that is also crevice corrosion attack, it is not the intended mode of failure in the tests. There is some controversy in the art about whether to count corrosion of this type as passing or failing the test procedure. Plateaus refer to the crevice former block used in the G-48-D test, in which a multiple crevice assembly is used. This multiple crevice assembly consists of two fluorocarbon segmented washers, each having 12 slots and 12 plateaus. This provides 24 possible crevice sites (one per plateau) per alloy sample. The standard judgment is that the more sites attacked, the greater the susceptibility of crevice corrosion.

TABLE I

Test Method - Modified ASTM G-48 Practice B
Test Solution - Acidified Ferric Chloride
Sample Preparation - Mill surface, Acid Cleaning

| Sample Code | Test Temp. | Weight Loss ($gm/cm^2$) | Deepest Crevice | Remarks |
|---|---|---|---|---|
| 19-B4A | 104° F. (40° C.) | 0.0000 | — | No apparent crevice attack |
| 19-B4-B | 104° F. (40° C.) | 0.0000 | — | No apparent crevice attack |
| 19-B5A | 113° F. (45° C.) | 0.0000 | 0.013" | Attack on edges |
| 19-B5B | 113° F. (45° C.) | 0.0000 | 0.003" | Attack on edges |
| 19-B1A | 122° F. (50° C.) | 0.0001 | 0.010" | Attack on edges and under one block |
| 19-B1B | 122° F. (50° C.) | 0.0001 | 0.004" | Attack on edges |
| 19-B2A | 131° F. (55° C.) | 0.0000 | 0.004" | Attack on edges |
| 19-B2B | 131° F. 55° C. | 0.0002 | 0.012" | Attack on edges and under one block |
| 19-B3A | 140° F. (60° C.) | 0.0109 | 0.058" | Attack on edges and under one block |
| 19-B3B | 140° F. (60° C.) | 0.0017 | 0.050" | Attack on edges and under two blocks |

Table 1 shows the results of a modified ASTM G-48 Practice B crevice corrosion test performed on an existing alloy having a $PRE_N$ equal to or greater than 50 prepared by the prior art method generally described above. The prior art alloy is a commercially available superaustenitic stainless steel including 20.0–22.0 weight percent chromium, 23.5–25.5 weight percent nickel, 6.0–7.0 molybdenum, and 0.18–0.25 nitrogen, wherein the chromium, molybdenum, and nitrogen contents provide a $PRE_N$ of at least 50. This alloy is sold under the name AL-6XN PLUS™ from Allegheny Ludlum Corporation. A typical AL-6XN PLUS™ alloy composition includes 21.8 weight percent chromium, 25.2 weight percent nickel, 6.7 weight percent molybdenum, and 0.24 weight percent nitrogen. AL-6XN PLUS™ alloy also may include the following maximum contents of other elements: 0.03 weight percent carbon; 2.0 weight percent manganese; 0.040 weight percent sulfur; 1.0 weight percent silicon; and 0.75 weight percent copper.

AL-6XN PLUS™ may be classified within a group of austenitic stainless steels including about 6 to about 7 weight percent molybdenum. Such alloys typically also include about 19 to about 22 weight percent chromium, about 17.5 to about 26 weight, and about 0.1 to about 0.25 weight percent nitrogen.

The Standard ASTM G-48 Practice B test used in the trials shown in Table 1 employed an acidified ferric chloride test solution instead of the straight solution specified in Practice B (all such references to "modified" tests in Tables 1–5 will refer to the use of acidified ferric chloride test solution rather than the straight solution specified by the ASTM standard). At elevated temperature (typically over about 95° F. (35° C.)), ferric chloride solution as specified for G-48 procedures A and B, begins to hydrolyze to ferric hydroxide and hydrochloric acid. This hydrolysis changes the solution and may possibly change the corrosivity of the solution. The addition of hydrochloric acid, as specified for G-48 procedures C and D, helps to suppress this hydrolysis and produce more consistent results. Referring to Table 1, at 104° F. (40° C.), this test shows two samples of the alloy having no apparent crevice attack and no weight loss.

At 113° F. (45° C.), both samples showed attack on the edges, but no weight loss. The 19-B5A sample experienced a crevice 0.013" deep, while the 19-B5B sample had a crevice depth of only 0.003". Neither sample experienced weight loss.

At 122° F. (50° C.), both samples experienced crevice corrosion and a weight loss of at least 0.0001 $gm/cm^2$. The 19-B1A sample experienced attack on the edges and under one block with a crevice depth of 0.010". The 19-B1B sample experienced attack on the edges with a crevice depth of 0.004".

At temperatures above 122° F. (50° C.), all samples experienced crevice corrosion, and all samples, except for 19-B2A, experienced weight loss. As the results of Table 1 indicate, the alloy prepared by prior art methods is characterized by a CCCT of 122° F. (50° C.).

TABLE 2

Test Method - Modified ASTM G-48 Practice D
Test Solution - Acidified Ferric Chloride
Sample Preparation - Mill surface, Acid Cleaning

| Sample Code | Test Temp. | Weight Loss ($gm/cm^2$) | Deepest Crevice | Remarks |
|---|---|---|---|---|
| 19-D4A | 104° F. (40° C.) | 0.0000 | — | Etch only |
| 19-D4B | 104° F. (40° C.) | 0.0000 | — | Etch only |
| 19-D5A | 113° F. (45° C.) | 0.0000 | 0.013" | Attack on 10 of 24 plateaus |
| 19-D5B | 113° F. (45° C.) | 0.0001 | 0.003" | Attack on 11 of 24 plateaus |
| 19-D1A | 122° F. (50° C.) | 0.0002 | 0.011" | Attack on 14 of 24 plateaus |
| 19-D1B | 122° F. (50° C.) | 0.0023 | 0.034" | Attack on 10 of 24 plateaus |
| 19-D2A | 131° F. (55° C.) | 0.0031 | 0.041" | Attack on 18 of 24 plateaus |
| 19-D2B | 131° F. (55° C.) | 0.0029 | 0.033" | Attack on 10 of 24 plateaus |
| 19-D3A | 140° F. (60° C.) | 0.0105 | >0.060" | Attack on 21 of 24 plateaus |
| 19-D3B | 140° F. (60° C.) | 0.0060 | 0.047" | Attack on 11 of 24 plateaus |

Table 2 shows the results of a modified ASTM G-48 Practice D crevice corrosion test on AL-6XN PLUSTM alloy that has been produced by a prior art method as described above. As noted above, AL-6XN PLUSTM has a $PRE_N$ equal to or greater than 50.

Referring to Table 2, at 113° F. (45° C.) and above, the samples showed attack on at least 10 of 24 plateaus with a crevice depth in the range of 0.003" to greater than 0.060" and weight loss up to 0.0060 gm/cm$^2$. The 19-D5B sample showed attack on 11 of 24 plateaus with a crevice depth of 0.003" and a weight loss of 0.0001 gm/cm$^2$. Under the test performed in Table 2, the alloy prepared by prior art methods is characterized by a CCCT of 113° (45° C.) to 122° F. (50° C.).

According to the present invention, to provide increased corrosion resistance as indicated by the CCCT without the need to increase the alloy content or $PRE_N$ value, a Cr—Ni—Mo stainless steel alloy may be homogenized by one or more operations. As described further below, the alloy may be homogenized by, for example, remelting or annealing for an extended time period. As used in the context of the present description of the invention, "homogenization" and "homogenize" refer to the process of reducing the extent of segregation of the major alloying elements in an alloy that contribute to the corrosion resistance of the alloy. A "homogenized" alloy or article is one that has been subjected to a homogenization as defined herein. In the present invention, the major alloying elements that contribute to corrosion resistance include molybdenum, which directly contributes to corrosion resistance as calculated by the above $PRE_N$ equation. Homogenization results in a more uniform alloy composition and prevents localized areas that are deficient in elements that contribute to corrosion resistance and which may be more susceptible to corrosion. The inventors have discovered that homogenizing an alloy having a $PRE_N$ equal to or greater than 50 imparts unexpectedly improved corrosion resistance to the alloy. The homogenization treatment contemplated herein will reduce the extent of segregation of major alloying elements in treated regions, but may not entirely alleviate segregation of such elements. Nevertheless, the inventors have discovered that reducing the extent of segregation of such elements in regions subjected to conditions promoting corrosion substantially enhances corrosion resistance as reflected by CCCT values.

Accordingly, following casting, at least a portion of the cast article, whether in slab, ingot, or other form, may be remelted to homogenize the portion. The inventors have discovered that remelting all or a portion of the article after casting homogenizes and reduces the occurrence of inclusions in the remelted portion. This represents a departure from conventional methods of making stainless steel. The remelting step may be carried out by electroslag remelting ("ESR") or other conventional methods known in the making of stainless steel, including, but not limited to, vacuum arc remelting (VAR), laser surface remelting, and electron beam (EB) remelting. The entire cast article may be remelted to homogenize the entire article and enhance corrosion resistance of all the surfaces of the article. Suitable techniques for remelting and homogenizing an entire cast article include, for example, ESR, VAR, and EB remelting. Alternatively, at least a surface region of the article may be remelted to homogenize the region and enhance the corrosion resistance of the surface. Suitable techniques for remelting and homogenizing a surface region of a cast article include laser surface remelting.

The known ESR process was developed as a means for reducing the concentration of undesirable impurities such as sulfur in an alloy through reaction with a controlled composition slag. ESR also has been recognized as a method for removing or altering inclusions. Use of ESR to deliberately control solidification-induced segregation of alloying elements like molybdenum is less common, and its use for this purpose is not a part of conventional stainless steelmaking practice.

VAR is often used to homogenize nickel base alloys such as alloy 718. VAR is typically used in the production of alloy 718 to reduce the degree of niobium segregation commonly present in ingot-cast or ESR material. Since the VAR process is conducted in a vacuum, VAR processing of a nitrogen-containing alloy—such as the alloy considered in Tables 1 and 2 above—is difficult. Notwithstanding this difficulty, with proper care, VAR might be adapted to homogenize such alloys.

Laser surface remelting is performed by rastering a laser beam over the entire surface of the article. The high rate of resolidification should yield a very fine dendrite spacing and thus allow rapid and essentially complete homogenization over the surface of the article.

The inventors have further discovered that homogenizing all or a portion of an article of a Cr—Ni—Mo stainless steel alloy having a $PRE_N$ equal to or greater than 50 by annealing the article for an extended time substantially improves the corrosion resistance of the article. The annealing treatment, referred to herein as an "extended annealing" treatment, may be performed either following, or in place of, the mill annealing step following hot working in the prior art process described above. Annealing is a treatment comprising exposing an article to elevated temperature for a period of time, followed by cooling at a suitable rate. Annealing is used primarily to soften metallic materials, but also may be used to simultaneously produce desired changes in other properties or in microstructure. Annealing usually is performed at a temperature at which undesirable phases, such as sigma, chi, and mu phases, are dissolved. In the present invention, at least a portion of the article is annealed at a temperature greater than 2000° F. (1079° C.) for a time period sufficient to homogenize (i.e., decrease segregation of major alloying elements within) the portion. For example, the extended annealing treatment may be performed by heating the article at 2050 to 2350° F. (1121 to 1288° C.) for a period longer than one hour, but is preferably performed by heating at about 2150° F. (1177° C.) for about two hours.

U.S. Pat. No. 5,019,184 describes the use of thermal homogenization for enhancing the corrosion resistance of nickel base alloys containing 19–23 weight percent Cr and 14–17 weight percent Mo. This homogenization is described as a method for reducing the formation of mu phase, $(Ni,Cr,Fe,Co)_3(Mo,W)_2$. Mu phase was identified as being detrimental to the corrosion resistance of the Ni—Cr—Mo alloy that was the subject material for that patent.

The '184 patent's process differs from the present invention for at least the reason that the goal of the prior art process was the elimination of an undesirable phase. In contrast, an aim of the present invention is the elimination of solute (molybdenum) poor regions within the austenite phase, which is the matrix phase for AL-6XN PLUS™ alloy and comprises nominally all of the alloy. FIG. 1 illustrates generally how an alloy may be homogenized by holding the alloy at an optimum homogenization temperature range just below the temperature of maximum solid solubility for an extended period of time. In doing so, diffusion of molybdenum will reduce composition gradients within the alloy.

In one embodiment of the method of the present invention, both the remelting and extended annealing steps are carried out to homogenize the Cr—Ni—Mo alloy. In an alternate embodiment, either the remelting step or extended annealing step is carried out alone. The chosen method may depend on the level of corrosion resistance desired and the cost of the additional processing steps.

As stated earlier, the CCCT of an alloy is the lowest temperature at which crevice corrosion occurs on samples of the alloy in a specific environment. The CCCT is typically determined in accordance with ASTM Standard G-48. The higher the CCCT, the greater the corrosion resistance of the alloy. Thus, for alloys exposed to corrosive environments, it is desirable for an alloy to possess as high a CCCT as possible. Examples 1 and 2, set forth below, illustrate the positive effect that the combination of an alloy with a $PRE_N$ equal to or greater than 50 subjected to at least partial homogenization according to the present invention has on the CCCT and corrosion resistance of the alloy. Incorporating the remelting and/or extended annealing steps into the prior art process, as set forth above, using the alloy composition investigated in the examples below, results in a superaustenitic stainless steel having superior corrosion resistance properties. These results are surprising insofar as while an increased $PRE_N$ has shown improved corrosion resistance properties, it was not previously known that homogenizing an alloy with a $PRE_N$ greater than 50 would provide further increased corrosion resistance.

EXAMPLE 1

TABLE 3

Test Method - Modified ASTM G-48 Practice B
Test Solution - Acidified Ferric Chloride
Sample Preparation - Mill surface, Acid Cleaning

| Sample Code | Test Temp. | Weight Loss ($gm/cm^2$) | Deepest Crevice | Remarks |
|---|---|---|---|---|
| 120B 451 | 113° F. (45° C.) | 0.0000 | — | No apparent crevice attack |
| 120B 452 | 113° F. (45° C.) | 0.0000 | — | No apparent crevice attack |
| 120B 501 | 122° F. (50° C.) | 0.0000 | — | No apparent crevice attack |
| 120B 502 | 122° F. (50° C.) | 0.0000 | — | No apparent crevice attack |
| 120B 551 | 131° F. (55° C.) | 0.0000 | — | No apparent crevice attack |
| 120B 552 | 131° F. (55° C.) | 0.0000 | — | No apparent crevice attack |
| 120B 651 | 149° F. (65° C.) | 0.0000 | — | No apparent crevice attack |
| 120B 652 | 149° F. (65° C.) | 0.0000 | — | Slight attack on one edge |

Table 3 shows the results of a modified ASTM G-48 Practice B crevice corrosion test performed on AL-6XN PLUS alloy that has been prepared by the prior art method as described above, and with the additional step of ESR after casting. No measurable crevice attack or weight loss occurred for any sample at temperatures ranging from 113–149° F. (45–65° C.). Sample 120B 651 showed evidence of a slight attack on one edge, but had no measurable crevice depth or weight loss. The CCCT of an alloy produced by the present invention is greater than 149° F. (65° C.). As Table 3 indicates, the corrosion results obtained with the ESR-processed alloy are superior to those of the alloy in Table 1, which was prepared by the same method, but without the additional ESR step. Without wishing to be limited by the following mechanism, it is believed that the higher CCCT is due to the fact that ESR processing provides greater homogenization of the major alloying elements in the surface region than does mill annealing alone. These results demonstrate the importance of a homogenizing treatment to obtain more desirable corrosion resistance in Cr—Ni—Mo stainless steels having a $PRE_N$ equal to or greater than 50.

EXAMPLE 2

TABLE 4

Test Method - Modified ASTM G-48 Practice B
Test Solution - Acidified Ferric Chloride
Sample Preparation - All surfaces heavily ground followed by Acid Cleaning

| Sample Code | Test Temp. | Weight Loss ($gm/cm^2$) | Deepest Crevice | Remarks |
|---|---|---|---|---|
| 19-CBE1 | 131° F. (55° C.) | 0.0001 | — | Very shallow attack on edges |
| 19-CBE2 | 131° F. (55° C.) | 0.0001 | — | Very shallow attack on edges |

Table 4 shows the results of a modified ASTM G-48 Practice B crevice corrosion test performed on AL-6XNPLUS™ alloy prepared by the prior art method described above, and with an additional two-hour extended annealing homogenization treatment at 2150° F. (1177° C.). At 131° F. (55° C.), both samples experienced a very shallow attack on the edges, but the crevice depth was not measurable. In addition, each sample experienced a weight loss of 0.0001 $gm/cm^2$. The data of Table 4 demonstrates that the homogenization performed by extended annealing produced an alloy having a CCCT greater than 131° F. (55° C.). These properties are substantially superior to those seen with the same alloy produced by conventional methods in Table 1, which produced a CCCT of 122° F. (50° C.). Table 4 again confirms the importance of homogenizing an alloy having a $PRE_N$ equal to or greater than 50 in order to obtain more desirable corrosion resistance properties.

TABLE 5

Test Method - Modified ASTM G-48 Practice D
Test Solution - Acidified Ferric Chloride
Sample Preparation - All surfaces heavily ground followed by Acid Cleaning

| Sample Code | Test Temp. | Weight Loss ($gm/cm^2$) | Deepest Crevice | Remarks |
|---|---|---|---|---|
| 19-CBE1 | 131° F. (55° C.) | 0.0000 | 0.001" | Attack on 1 of 24 plateaus |
| 19-CBE2 | 131° F. (55° C.) | 0.0000 | 0.0005" | Attack on 1 of 24 plateaus |

Table 5 shows the results of a modified ASTM G-48 Practice D crevice corrosion test performed on AL-6XNPLUS™ alloy prepared by the prior art method described above, and with an additional two-hour extended anneal homogenization treatment at 2150° F. (1177° C.). The 19-CBE1 sample of Example 5 showed attack on 1 of 24 plateaus, a crevice depth of 0.001", and no weight loss. The 19-CBE2 sample showed attack on 1 of 24 plateaus, a crevice depth of 0.0005", and no weight loss.

The alloy of Table 5, which underwent extended annealing for purposes of homogenization, showed only minimal attack at 131° F. (55° C.). As indicated by the above results, the alloy of Table 5 has a CCCT of at least 131° F. (55° C.). These results are superior to those seen with the alloy in Table 2, which produced a CCCT of 113° F. (45° C.) under the same test conditions for an alloy produced by the prior art methods.

One of ordinary skill in the art may readily determine an appropriate point at which to include the extended annealing homogenization treatment of the present invention. Possible extended annealing techniques include, for example, a box anneal and a line anneal. The most suitable choice of technique will depend on factors including cost and processing concerns. If, for example, the alloy is to be processed into plate, the extended anneal may be carried out by batch annealing a number of the plates in a box anneal furnace. If the alloy is to be processed to sheet, slabs may be subjected to the extended annealing treatment in a batch operation, and then the heated slabs may be hot rolled. Alternatively, slabs processed to final thickness as sheet product may be line annealed at a temperature greater than 2000° F. (1079° C.) for a period sufficient to homogenize the alloy. In the above Tables 4 and 5, the samples were processed to final gauge before being treated by extended annealing. Because the homogeneity of the surfaces exposed to conditions promoting corrosion is of primary importance, it is believed that techniques adapted to homogenize the surface regions of interest by an extended annealing treatment also will significantly enhance corrosion resistance.

The above examples indicate that the Cr—Ni—Mo alloys processed by the method of the present invention possess superior corrosion resistance, as measured by CCCT, when compared with an alloy of the same composition processed by prior art methods. Tables 1 and 2 indicate that the CCCT of AL-6XN PLUS™ alloy is about 122° F. (50° C.) using the modified G-48 Practice B crevice corrosion test and about 113° F. (45° C.) using the modified ASTM G-48 Practice D test. These CCCT values are greater than those for another prior art Cr—Ni—Mo stainless steel known as AL-6XN® (available from Allegheny Ludlum Corp.), which typically has a $PRE_N$ of approximately 47. That prior art alloy can be characterized by a CCCT of about 110° F. (43° C.) in the modified G-48 Practice B crevice corrosion test, and 95° F. (35° C.) in the standard (unmodified) G-48 Practice D crevice corrosion test. The additional increase in CCCT achieved by processing AL-6XN PLUS™ alloy using the method of the present invention was significant and unexpected. The additional gains in corrosion resistance achieved through use of the invention did not require further alloying additions to increase $PRE_N$, and processing difficulties associated with handling higher alloyed material were avoided.

Figure 2:
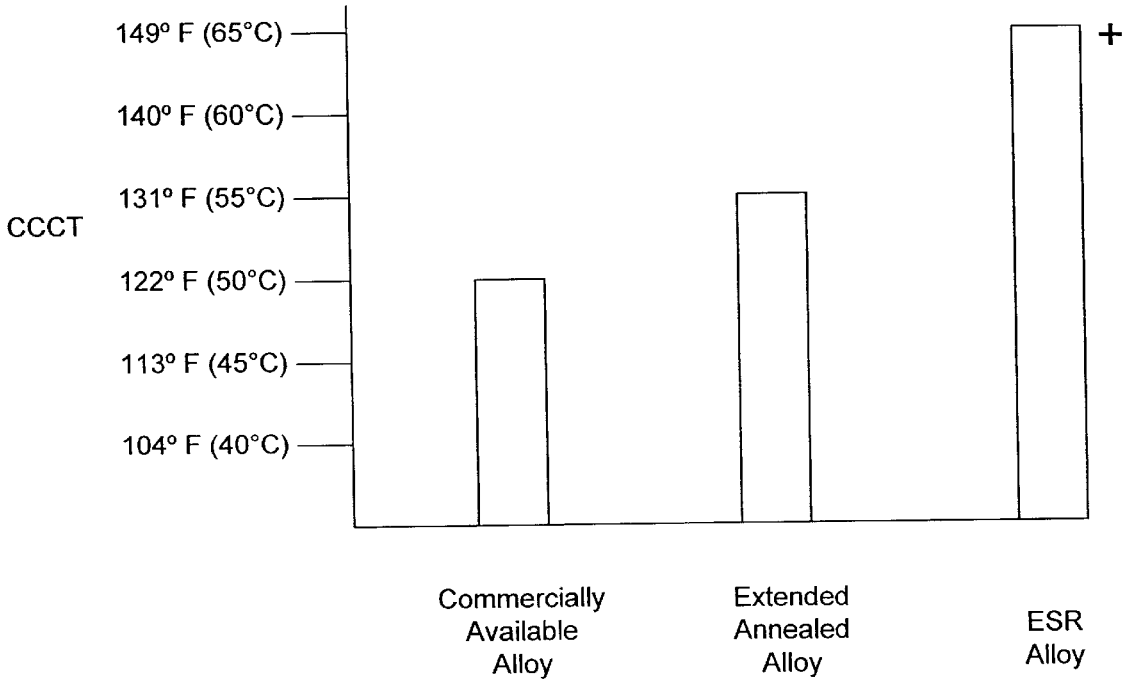
FIG. 2 is a bar graph comparing the CCCT values obtained from the results of a modified ASTM G-48 Practice B crevice corrosion test performed on (i) a non-homogenized stainless steel with a $PRE_N$ equal to or greater than 50 produced by a prior art method, (ii) a Cr—Ni—Mo stainless steel with a $PRE_N$ equal to or greater than 50 produced by a prior art method and ESR-processed, and (iii) a Cr—Ni—Mo stainless steel with a $PRE_N$ equal to or greater than 50 produced by a prior art method and annealed at 2150° F. (1177° C.) for about two hours.
Figure 3:
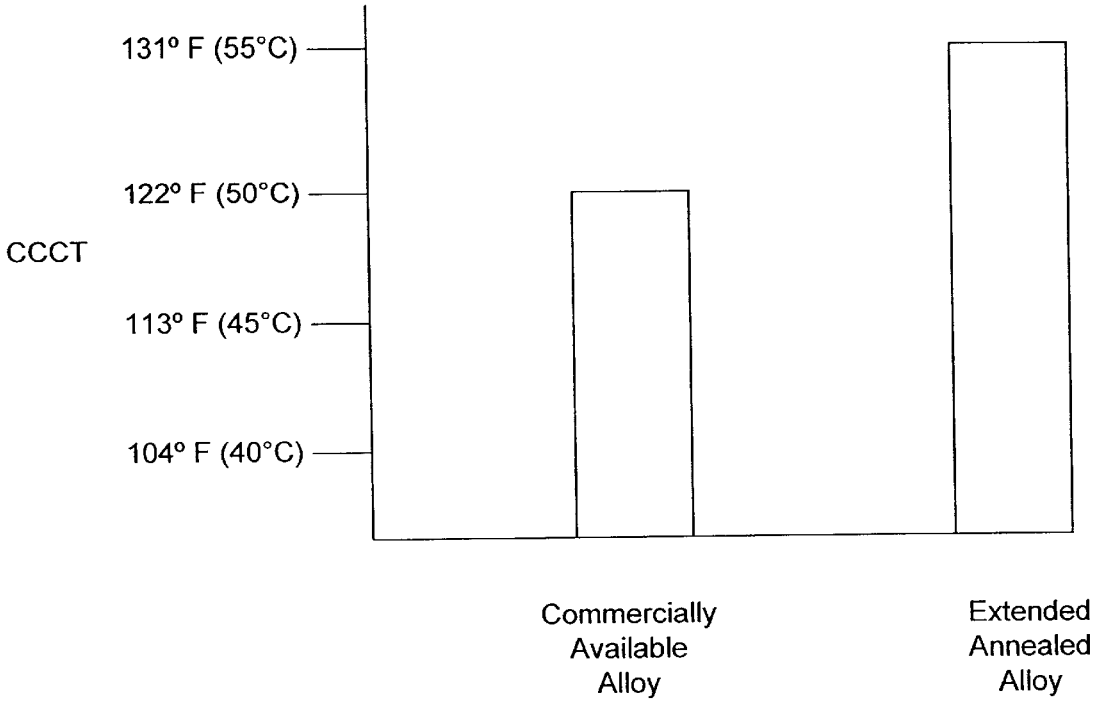
FIG. 3 is a bar graph comparing the CCCT values obtained from the results of a modified ASTM G-48 Practice D crevice corrosion test performed on (i) a non-homogenized Cr—Ni—Mo stainless steel with a $PRE_N$ equal to or greater than 50 prepared by a prior art method, and (ii) a Cr—Ni—Mo stainless steel with a $PRE_N$ equal to or greater than 50 prepared by a prior art method and annealed at 2150° F. (1177° C.) for about two hours.

FIGS. 2 and 3 graphically illustrate the effect of the present invention on an alloy's CCCT value. FIG. 2 is a bar graph comparing CCCT values obtained from the results of a modified ASTM G-48 Practice B crevice corrosion test performed on a non-homogenized alloy with a $PRE_N$ equal to or greater than 50 produced by a prior art method ("commercially available alloy"), an alloy with a $PRE_N$ equal to or greater than 50 prepared by a prior art method and then homogenized by an extended annealing at 2150° F. (1177° C.) for at least two hours ("extended annealed alloy"), and an alloy with a $PRE_N$ equal to or greater than 50 prepared by a prior art method and homogenized by ESR ("ESR alloy"). The commercially available alloy displayed a CCCT of 122° F. (50° C.). The extended annealed alloy showed a CCCT of at least 131° F. (55° C.), while the ESR alloy had a CCCT of at least 149° F. (65° C.).

FIG. 3 is a bar graph comparing the CCCT values obtained from the results of a modified ASTM G-48 Practice D crevice corrosion test performed on a non-homogenized alloy with a $PRE_N$ equal to or greater than 50 prepared by a prior art method ("commercially available alloy"), and an alloy with a $PRE_N$ equal to or greater than 50 prepared by a prior art method and homogenized by an extended annealing at 2150° F. (1177° C.) for at least two hours ("extended annealed alloy"). The commercially available alloy displayed a CCCT of 113° F. (45° C.), while the extended annealed alloy had a CCCT of at least 131° F. (55° C.).

It is to be understood that the present description illustrates those aspects of the invention relevant to a clear understanding of the invention. Certain aspects of the invention that would be apparent to those of ordinary skill in the art and that, therefore, would not facilitate a better understanding of the invention have not been presented in order to simplify the present description. Although the present invention has been described in connection with certain embodiments, those of ordinary skill in the art will, upon considering the foregoing description, recognize that many modifications and variations of the invention may be employed. It is intended that all such variations and modifications of the inventions are covered by the foregoing description and following claims.

We claim:

1. A method for improving corrosion resistance of a stainless steel comprising an austenite phase, the method comprising:

providing an article of a stainless steel comprising chromium, nickel, and molybdenum and having a $PRE_N$ of at least 50 as determined by the equation $$PRE_N = Cr + (3.3 \times Mo) + (30 \times N),$$

wherein Cr is weight percent chromium, Mo is weight percent molybdenum, and N is weight percent nitrogen, all based on total weight of the steel; and homogenizing at least a portion of the article by electron beam remelting the portion.

2. The method of claim 1, wherein providing an article comprises:

providing a melt of the stainless steel; and casting the melt to form the article.

3. A method for improving corrosion resistance of a stainless steel, the method comprising:

providing an article of a stainless steel comprising chromium, nickel, and molybdenum and having a $PRE_N$ of at least 50 as determined by the equation $$PRE_N = Cr + (3.3 \times Mo) + (30 \times N),$$

wherein Cr is weight percent chromium, Mo is weight percent molybdenum, and N is weight percent nitrogen, all based on total weight of the steel; and homogenizing at least a surface region of the article by laser surface remelting the region.

4. The method of claim 1, wherein the article is one of an ingot, a slab, and a plate.

5. The method of claim 1, wherein remelting at least a portion of the article reduces the extent of segregation of molybdenum in the portion.

6. The method of claim 1, wherein the stainless steel comprises:

14 to 22 weight percent chromium;

17 to 40 weight percent nickel;

6 to 12 weight percent molybdenum; and 0.15 to 0.50% nitrogen, all based on the total weight of the stainless steel.

7. The method of claim 6, wherein the stainless steel comprises:

19 to 22 weight percent chromium, 17.5 to 26 weight percent nickel;

6 to 7 weight percent molybdenum; and 0.1 to 0.25 weight percent nitrogen, all based on the total weight of the stainless steel.

8. The method of claim 7, wherein the stainless steel comprises:

20 to 22 weight percent chromium;

23.5 to 25.5 weight percent nickel;

6.0 to 7.0 weight percent molybdenum;

and 0.18 to 0.25 weight percent nitrogen, all based on the total weight of the stainless steel.

9. The method of claim 6, wherein the stainless steel comprises:

about 21.8 weight percent chromium;

about 25.2 weight percent nickel;

about 6.7 weight percent molybdenum; and about 0.24 weight percent nitrogen, all based on the total weight of the stainless steel.

10. The method of claim 6, wherein the stainless steel further comprises up to 6% manganese by weight.

11. The method of claim 1, further comprising, subsequent to remelting a portion of the article, hot rolling the stainless steel.

12. The method of claim 3, further comprising, subsequent to laser surface remelting at least a portion of the article, annealing the stainless steel.

13. The method of claim 12, wherein annealing the stainless steel comprises heating the stainless steel to a temperature greater than 2000° F. (1149° C.) and maintaining the stainless steel at the heating temperature for a time period sufficient to homogenize the stainless steel.

14. The method of claim 13, wherein annealing comprises heating the stainless steel to a temperature in the range of 2050 to 2350° F. (1121 to 1288° C.) and maintaining the stainless steel at the heating temperature for longer than 1 hour.

15. The method of claim 14, wherein annealing the stainless steel comprises heating the stainless steel to a temperature of at least 2150° F. (1177° C.) and maintaining the stainless steel at the heating temperature for at least about 2 hours.

16. A method for improving corrosion resistance of a stainless steel comprising an austenite phase, the method comprising:

providing an article of a stainless steel comprising chromium, nickel, and molybdenum and having a $PRE_N$ of at least 50 as determined by the equation $$PRE_N = Cr + (3.3 \times Mo) + (30 \times N),$$

wherein Cr is weight percent chromium, Mo is weight percent molybdenum, and N is weight percent nitrogen, all based on total weight of the steel; and homogenizing and substantially eliminating molybdenum poor regions in at least a portion of the austenite phase of the article by annealing the portion.

17. The method of claim 16, wherein providing an article comprises:

providing a melt of the stainless steel;

casting the melt to form the article.

18. The method of claim 17, wherein the article is one of an ingot and a slab.

19. The method of claim 17, wherein providing an article comprises;

providing a melt of the stainless steel;

casting the melt to one of an ingot and a slab of the stainless steel; and further processing the stainless steel to form the article.

20. The method of claim 19, wherein further processing the stainless steel comprises at least one of hot rolling, forging, and cold rolling the stainless steel.

21. The method of claim 20, wherein the article is one of a plate and a sheet.

22. The method of claim 16, wherein annealing at least a portion of the article reduces the extent of segregation of molybdenum in the portion.

23. The method of claim 16, wherein annealing at least a portion of the article comprises at least one of a batch annealing and line annealing the article.

24. The method of claim 16, wherein the stainless steel comprises:

14 to 22 weight percent chromium;

17 to 40 weight percent nickel;

6 to 12 weight percent molybdenum;

and 0.15 to 0.50% nitrogen, all based on the total weight of the stainless steel.

25. The method of claim 24, wherein the stainless steel comprises:

19 to 22 weight percent chromium, 17.5 to 26 weight percent nickel;

6 to 7 weight percent molybdenum; and 0.1 to 0.25 weight percent nitrogen, all based on the total weight of the stainless steel.

26. The method of claim 25, wherein the stainless steel comprises:

20 to 22 weight percent chromium;

23.5 to 25.5 weight percent nickel;

6.0 to 7.0 weight percent molybdenum;

and 0.18 to 0.25 weight percent nitrogen, all based on the total weight of the stainless steel.

27. The method of claim 26, wherein the stainless steel comprises:

about 21.8 weight percent chromium;

about 25.2 weight percent nickel;

about 6.7 weight percent molybdenum; and about 0.24 weight percent nitrogen, all based on the total weight of the stainless steel.

28. The method of claim 25, wherein the stainless steel further comprises up to 6% manganese by weight.

29. The method of claim 16, wherein annealing at least a portion of the article comprises heating at least a portion of the article to a temperature greater than 2000° F. (1149° C.) and maintaining the portion at the heating temperature for a time period sufficient to homogenize the portion.

30. The method of claim 29, wherein annealing at least a portion of the article comprises heating at least a portion of the article to a temperature in the range of 2050 to 2350° F. (1121 to 1288° C.) and maintaining the portion at the heating temperature for longer than 1 hour.

31. The method of claim 30, wherein annealing at least a portion of the article comprises heating at least a portion of the article to a temperature of at least 2150° F. (1177° C.) and maintaining the stainless steel at the heating temperature for at least about 2 hours.

32. The method of claim 19, further comprising, subsequent to casting the melt to one of an ingot and a slab, remelting at least a portion of the ingot or slab to homogenize the portion.

33. A method for improving corrosion resistance of a stainless steel, the method comprising:

providing a melt of a stainless steel comprising 20 to 22 weight percent chromium, 23.5 to 25.5 weight percent nickel, 6.0 to 7.0 weight percent molybdenum, and 0.18 to 0.25 weight percent nitrogen, and having a $PRE_N$ of at least 50 as determined by the equation $PRE_N$=Cr+(3.3×Mo)+(30N), wherein Cr is weight percent chromium, Mo is weight percent molybdenum, and N is weight percent nitrogen, all weight percentages based on total weight of the steel;

casting the melt to form an article of the stainless steel;

homogenizing at least a portion of the article by electron beam remelting the portion under conditions sufficient to reduce segregation in the portion of molybdenum and other major alloying elements and enhance corrosion resistance of the portion; and further processing the stainless steel to a final gauge.

34. A method for improving corrosion resistance of a stainless steel, the method comprising:

providing a melt of a stainless steel comprising 20 to 22 weight percent chromium, 23.5 to 25.5 weight percent nickel, 6.0 to 7.0 weight percent molybdenum, and 0.18 to 0.25 weight percent nitrogen, and having a $PRE_N$ of at least 50 as determined by the equation $PRE_N$Cr+(3.3×Mo)+(30×N), wherein Cr is weight percent chromium, Mo is weight percent molybdenum, and N is weight percent nitrogen, all weight percentages based on total weight of the steel;

casting the melt to form an article of the stainless steel; and homogenizing and substantially eliminating molybdenum poor regions in at least a portion of the stainless steel by annealing the portion for a sufficient period of time at a temperature of at least 2000° F. (1093° C.).

35. A stainless steel produced by a method comprising:

providing an article of a stainless steel comprising chromium, nickel, and molybdenum and having a $PRE_N$ of at least 50 as determined by the equation PREN=Cr+(3.3×Mo)+(30×N), wherein Cr is weight percent chromium, Mo is weight percent molybdenum, and N is weight percent nitrogen, all based on total weight of the steel; and electron beam remelting at least a portion of the article to homogenize the portion; and further processing the stainless steel to a final gauge.

36. A stainless steel produced by a method comprising:

providing an article of a stainless steel comprising chromium, nickel, and molybdenum and having a $PRE_N$ of at least 50 as determined by the equation $PRE_N$Cr+(3.3×Mo)+(30×N), wherein Cr is weight percent chromium, Mo is weight percent molybdenum, and N is weight percent nitrogen, all based on total weight of the steel; and homogenizing and substantially eliminating molybdenum poor regions in at least a portion of the article by annealing the portion.

37. An article of manufacture comprising the stainless steel of any of claims 35 and 36.

* * * * *